US010807826B2

(12) United States Patent
Buffa et al.

(10) Patent No.: US 10,807,826 B2
(45) Date of Patent: Oct. 20, 2020

(54) GLUING GROUP FOR A REWINDING MACHINE FOR APPLYING GLUE TO AN END EDGE OF A LOG, REWINDING MACHINE BEARING SUCH GROUP AND RELATED GLUING METHOD

(71) Applicant: GAMBINI S.p.A., Milan (IT)

(72) Inventors: Giovanni Buffa, Ponte Buggianese (IT); Fabio Picchi, Lammari (IT)

(73) Assignee: GAMBINI S.P.A., Milan (IT)

( * ) Notice: Subject to any disclaimer, the term of this patent is extended or adjusted under 35 U.S.C. 154(b) by 212 days.

(21) Appl. No.: 15/968,177

(22) Filed: May 1, 2018

(65) Prior Publication Data

US 2018/0319616 A1 Nov. 8, 2018

(30) Foreign Application Priority Data

May 5, 2017 (IT) ..... 102017000048930

(51) Int. Cl.
*B65H 37/02* (2006.01)
*B65H 18/08* (2006.01)
(Continued)

(52) U.S. Cl.
CPC ..... *B65H 37/02* (2013.01); *B65H 18/08* (2013.01); *B65H 19/2269* (2013.01); *B65H 19/29* (2013.01); *B05C 1/083* (2013.01); *B05C 1/0882* (2013.01); *B05C 1/165* (2013.01); *B65H 2301/414421* (2013.01);
(Continued)

(58) Field of Classification Search
CPC .... B65H 37/02; B65H 19/29; B65H 19/2269; B65H 2301/414436; B65H 2301/414421; B65H 2408/235
See application file for complete search history.

(56) References Cited

U.S. PATENT DOCUMENTS 8,424,481 B2 * 4/2013 Tsai ..... B05C 1/0817 118/261
2006/0208127 A1 * 9/2006 Tsai ..... B65H 19/2269 242/526

(Continued)

FOREIGN PATENT DOCUMENTS

EP 0493297 A2 7/1992
EP 2045201 A1 4/2009

(Continued)

OTHER PUBLICATIONS

International Search Report for PCT/IB2017/054779; European Patent Office; dated Nov. 9, 2017.

*Primary Examiner* — Sang K Kim
(74) *Attorney, Agent, or Firm* — King & Schickli, PLLC

(57) ABSTRACT

A gluing group for a rewinding machine for applying glue to an end edge of a log comprising a delivery roller (12) supported in an idle manner by supporting and translation guiding elements (15, 16), delivery means (20) for delivering a glue line (11''') on one of the generatrices of the delivery roller (12), a linear actuator (30) connected to said delivery roller (12) to transmit the approaching and distancing movement of the delivery roller (12) against the paper (11) being wound onto a contrast roller (115).
A rewinding machine comprising such gluing group and a related method for gluing the end edge also form part of the invention.

12 Claims, 4 Drawing Sheets

(51) Int. Cl.

| | |
|---|---|
| ***B65H 19/22*** | (2006.01) |
| ***B65H 19/29*** | (2006.01) |
| *B05C 1/16* | (2006.01) |
| *B05C 1/08* | (2006.01) |

(52) U.S. Cl.
CPC ..... *B65H 2301/414436* (2013.01); *B65H 2301/51132* (2013.01); *B65H 2404/14* (2013.01); *B65H 2408/235* (2013.01); *B65H 2701/1924* (2013.01)

(56) References Cited

U.S. PATENT DOCUMENTS

| | | | | |
|---|---|---|---|---|
| 2010/0129543 | A1 | 5/2010 | Tsai | |
| 2010/0237179 | A1* | 9/2010 | De Matteis ..... | B65H 19/2269 242/521 |

FOREIGN PATENT DOCUMENTS

| | | | |
|---|---|---|---|
| JP | H0243970 | A | 2/1990 |
| WO | WO2008050370 | A2 | 5/2008 |

* cited by examiner

GLUING GROUP FOR A REWINDING MACHINE FOR APPLYING GLUE TO AN END EDGE OF A LOG, REWINDING MACHINE BEARING SUCH GROUP AND RELATED GLUING METHOD

The disclosure of Italian Patent application 102017000048930 is included by reference.

FIELD OF THE INVENTION

The present invention relates to a gluing group for a rewinding machine for applying glue to an end edge of a log, a rewinding machine bearing such group and a related gluing method.

BACKGROUND

It is known to arrange a device for gluing an end edge of a log downstream of a rewinding machine. Through the deposition of glue, such device performs the closing of the end edge of rolls of paper for domestic use, toilet paper and the like, usually known as "logs", previously realized by a rewinding machine by winding one or more veils of paper onto a cardboard core. The log with the end edge firmly constrained through a certain amount of glue is then cut into a plurality of small rolls in a cutting machine.

Known devices for gluing the end edge have over the years seen successions of different technological solutions for applying glue onto the end edge itself or onto a section of log with the edge unwound.

The technology of the 1980s was that of opening the edge of the log on the advancement plane and dispensing a certain amount of glue onto the edge of the open log on the advancement plane through a glue nozzle that moved parallel to the log itself. Then the edge bearing the glue was closed onto the log and through a pair of rollers the log was rotated on itself to give consistency to the gluing of the paper.

The main drawbacks of such technical solutions consisted of the speed limits due to the transverse movement of the nozzle, and the imprecision of the glue spray due to the distance necessarily present between the nozzles and the unwound edge on the feeding plane.

Subsequently, to increase the speed of the machine in terms of logs per minute, there was a transition to gluers that deliver the glue directly onto the previously opened log, i.e. after unwinding the end edge, to then close the log again in order to perform the gluing of the edge on the log bearing the glue. In these machines, the delivery of the glue takes place for example with the passage of the log through rolling on a slit from which the dosed dispensing of the glue takes place by overflowing or with the log taking the adhesive from an element that bears adhesive through a linear element or blade, that is immersed in the glue, and transfers the glue to the log.

However, this system has the main drawback of a fairly significant contamination of the glue of the log, since the glue passes into the log through various windings, causing difficulties in the opening of the log when it is used with the consequent reduction of the product quality.

The difficulty of these known end edge gluers in dispensing and distributing glue uniformly, in a dosed measure and exactly in the desired position, further creates a higher consumption of glue.

It follows that these drawbacks have repercussions first of all on the quality of the logs produced, which should ideally only have their end edge glued and not also the subsequent windings, and also on the quality of the subsequent cutting of the rolls, which tend to open if the cut is not in direct proximity to the glued portion.

The efficiency of the machines is also penalized, for example, by the risk of dirtying the components of the gluer with excess glue and therefore the logs subsequently fed, causing machine downtime for maintenance.

In the subsequent cutting of the rolls, the opening of a waste roll, known as the trim roll, not correctly glued would also cause downtime of the cutting machine.

In addition to these problems, it is to be considered that gluers of the end edge of a log are particularly complicated both from a construction point of view and from the point of view of the action performed between the various parts that determine the log to be advanced, the end edge to be unwound, at least in a portion thereof, and position the glue. In fact, after being unwound from the log, the end edge of the predetermined entity must be phased and kept in phase in particular with the glue dispenser during its transfer towards such dispenser.

SUMMARY

The object of the present invention is to provide a gluing group for a rewinding machine for applying glue to an end edge of a log, a rewinding machine bearing such group and a related gluing method, which allows the gluing of the end edge of a log to be integrated into the rewinding process, without the presence of a dedicated device downstream of the rewinding machine, with which the rewinding machine has to be phased.

Another object of the present invention is to provide a gluing group for a rewinding machine for applying glue to an end edge of a log, a rewinding machine bearing such group and a particularly simple and functional related gluing method, with contained costs.

These objects according to the present invention are achieved by providing a gluing group for a rewinding machine for applying glue to an end edge of a log, a rewinding machine bearing such group and a related gluing method as disclosed in the independent claims.

Further characteristics are envisaged in the dependent claims.

BRIEF DESCRIPTION OF DRAWINGS

The characteristics and advantages of a gluing group for a rewinding machine for applying glue to an end edge of a log, of a rewinding machine bearing such group and of a related gluing method according to the present invention will be more apparent from the following exemplifying and non-limiting description, with reference to the attached schematic drawings, wherein.

DETAILED DESCRIPTION

Figure 1:
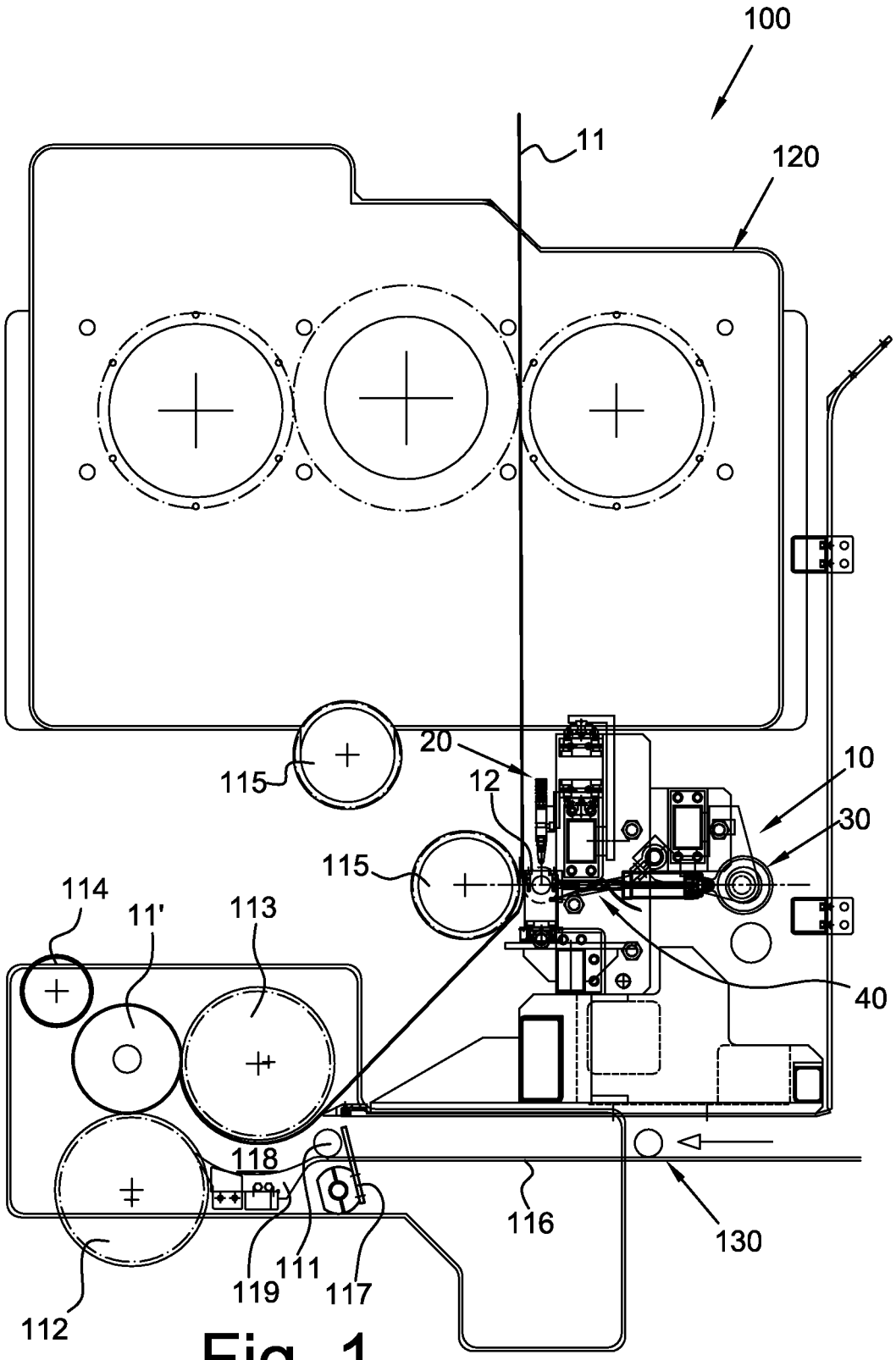
FIG. 1 is a lateral schematic view of a rewinding machine bearing the gluing group for applying glue to an end edge of a log according to the present invention.

With reference to the figures, a gluing group is shown for a rewinding machine for applying glue to an end edge of a log, generally indicated with reference numeral 10, integrated into a rewinding machine 100.

The rewinding machine 100 comprises three rollers with axes parallel to each other and perpendicular to the feed direction of the paper 11, wherein two lower 112 and upper 113 winding rollers are supported on the frame, i.e. on two opposing flanks 101, during the winding of a roll 11', known as a log, and collaborate with a third oscillating roller 114, known as the press roller, maintained in pressure on the roll 11' being formed during the winding.

The paper 11 being wound, generally at a speed of 600-700 m/min, shown in FIG. 1 with a thick line, is passed in a known way through a piercing station 120, comprising piercing rollers, to be equipped with a series of transverse piercing and weakening lines, spaced out according to regular intervals along its longitudinal extension, which identify the so-called "tears". At the outlet of the piercing station 120, the paper 11 is returned around at least one return roller 115 upstream of the upper winding roller 113.

The roll 11' being wound, after the exchange step, i.e. after being separated from the paper 11 being wound, exits from an outlet opening identified between the lower winding roller 112 and the third oscillating roller 114. The exchange step means the step in which the end of the winding of a log 11' and the start of a new winding take place.

The cores 111 are fed, according to known methods, one after the other, towards the winding zone of the log 11' by a feeding group for feeding cores 130. According to what is shown by way of example in FIG. 1 the feeding group for feeding cores 130 comprises a conveyor 116 and an oscillating pusher 117 that inserts the cores 111 into a channel 118 formed between the upper winding roller 113 and the underlying curved elements 119, known as cradles.

The tear of the paper 11 in the exchange step takes place along a predetermined piercing line 11", chosen according to the length of the log to be realized, and is performed through known mechanical tearing means, not shown as they are not part of the invention.

In the rewinding machine 100 according to the invention the application of the glue line 11''' on the end edge of the log 11' being wound is performed directly during the winding step.

For that purpose, the gluing group 10 for applying glue on an end edge of a log approaches one of the return rollers 115 of the rewinding machine to deposit a glue line 11''' by contact on the paper 11 being wound in a predetermined position with respect to the piercing line 11" along which the separation of the formed log 11' is performed in the exchange step. The phasing is in particular performed so that the glue line 11''' remains on the last tear of the exiting log and can therefore be used to keep the log closed on itself after the edge has been rewound onto the formed log.

"Glue line" means a distribution of glue on the paper 11 with a rectilinear extension along the width of the paper 11, i.e. orthogonally with respect to the advancement direction of the paper 11, which can comprise a plurality of mutually discontinuous chunks.

The gluing group 10 for applying glue onto an end edge according to the invention comprises a delivery roller 12 supported in an idle manner through a plurality of supporting elements 15 coupled to translation slides 16, the slides being constrained to a first transverse bar 17 arranged between the flanks 101, constituting supporting and translation guiding elements.

The delivery roller 12 is preferably made of plastic material, carbon fiber or another low inertia and non-stick material, onto which a glue line 11''' is previously delivered, preferably comprising various chunks, through delivery means 20 for delivering a glue line 11'''.

The delivery roller 12, according to a preferred embodiment, is provided in the form of various roller chunks 12', in the example four roller chunks 12', which are aligned on a single axis 14 and supported by the supporting elements 15, for example at the ends of the chunks 12'.

The delivery means 20 for delivering a glue line 11''' comprise a series of guns 21 fed by a glue tank under pressure, not shown, which, during operation, move transversely along the delivery roller 12, in order to make glue segments on one of the generatrices of the delivery roller 12.

The guns 21, in the example one gun for each roller chunk 12' are each supported by an own supporting and translation guiding element, comprising a runner 22, movable by means of a belt drive 23 along a lower guide 24 arranged in sections having an equivalent length to the desired displacement on a further transverse bar 17 placed between the flanks 101.

Figure 3:
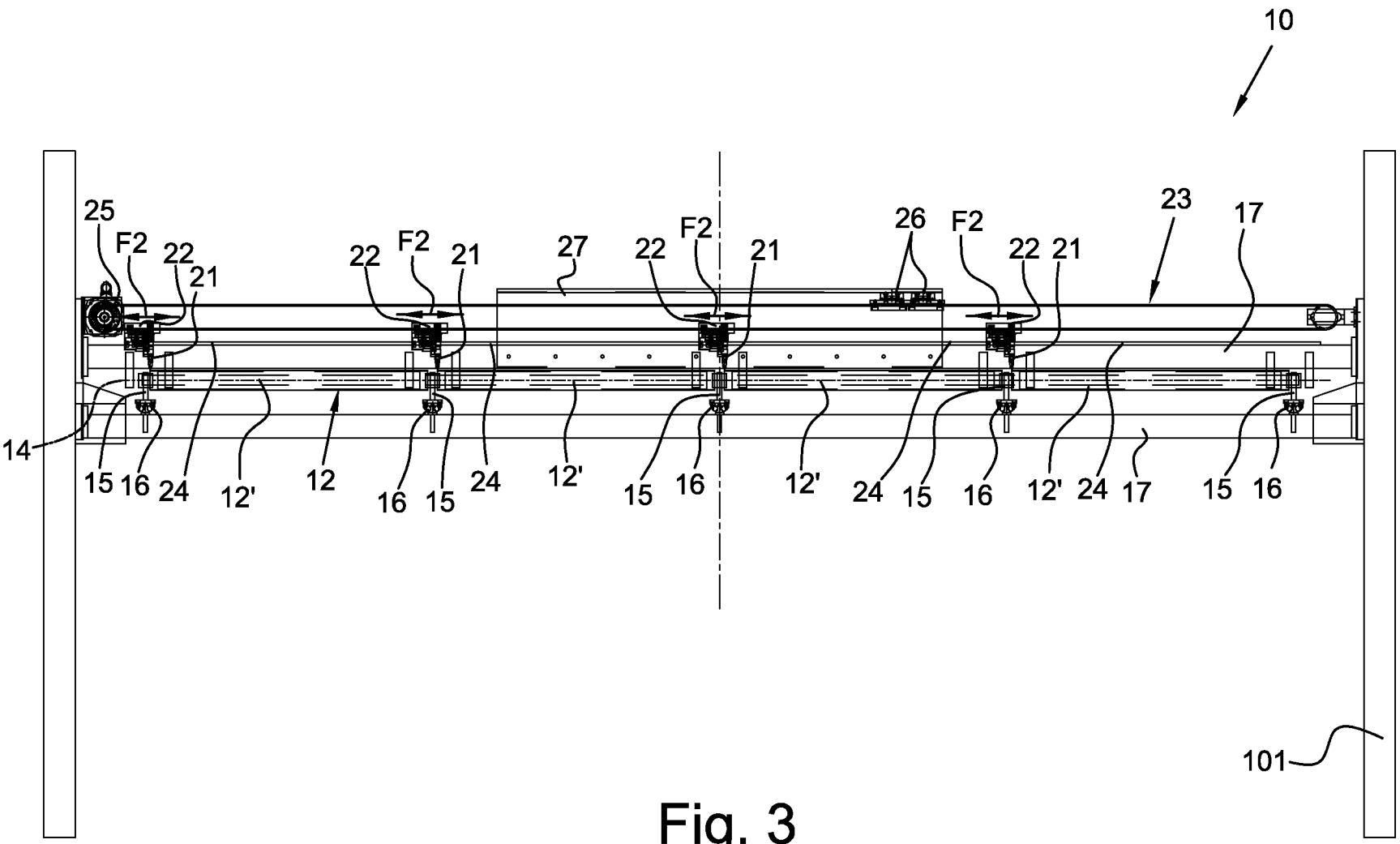
FIG. 3 is a front view of a detail of the gluing group of FIG. 2.
Figure 4:
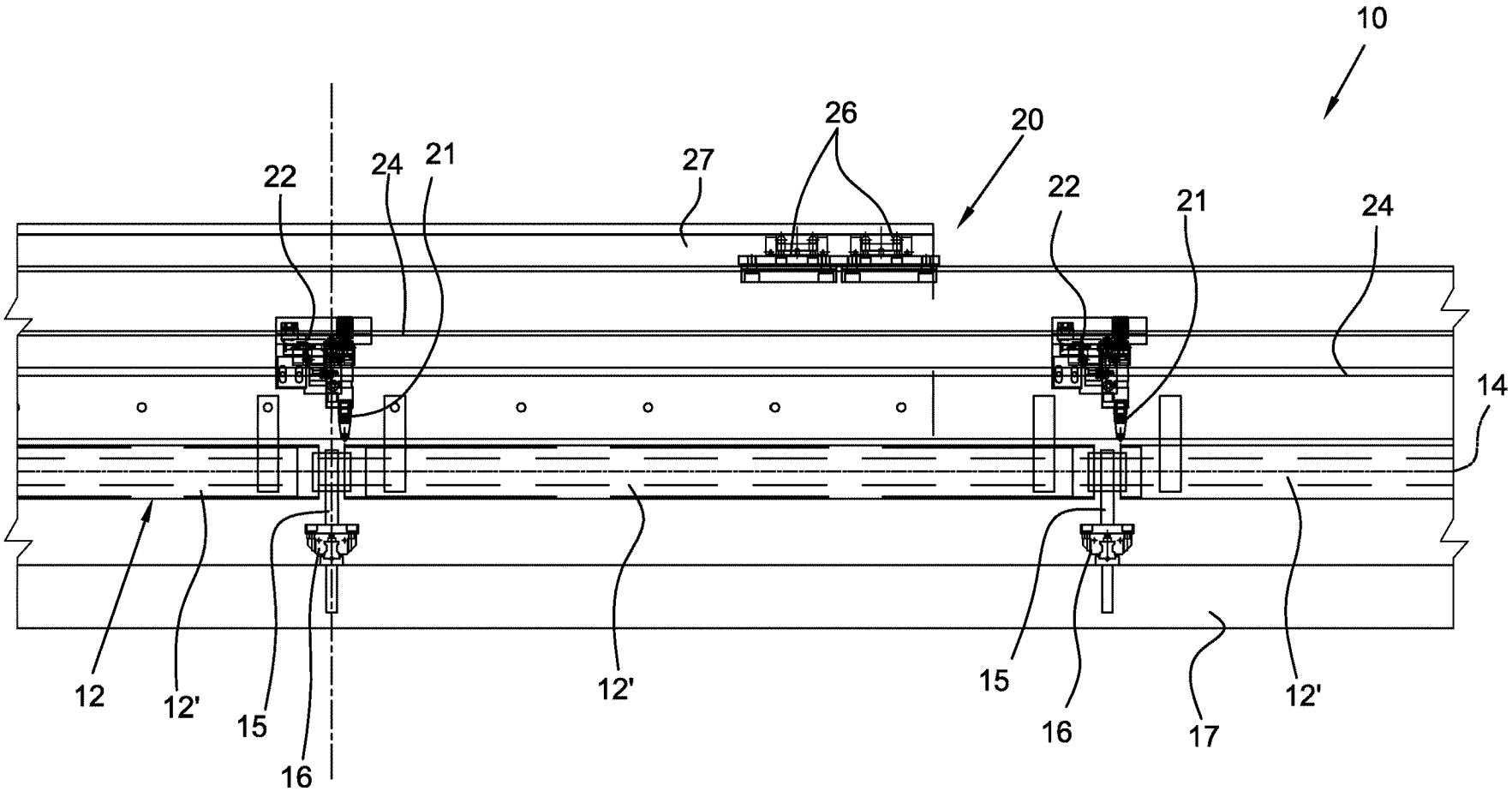
FIG. 4 shows an enlarged detail of FIG. 3.

The belt 23, wound in a ring, is moved by a motor 25 with an alternating linear movement, i.e. a movement forwards and backwards according to the arrow F2 shown in FIG. 3.

Each gun 21 can deliver glue onto the delivery roller 12 both during the advancement movement and during the return movement or even during both movements if the machine times permit this. In fact, the delivery of the glue onto the delivery roller 12 by the guns 21 must take place during the winding step of the log 11' being formed, which constitutes idle waiting time for the gluing group 10, during which the delivery roller 12 is prepared with a glue line 11''' for the subsequent gluing step.

The belt 23 is supported and guided in the central portion of the upper branch by further runners 26 constrained to an upper guide 27 integral with the transverse bar 17.

Figure 2:
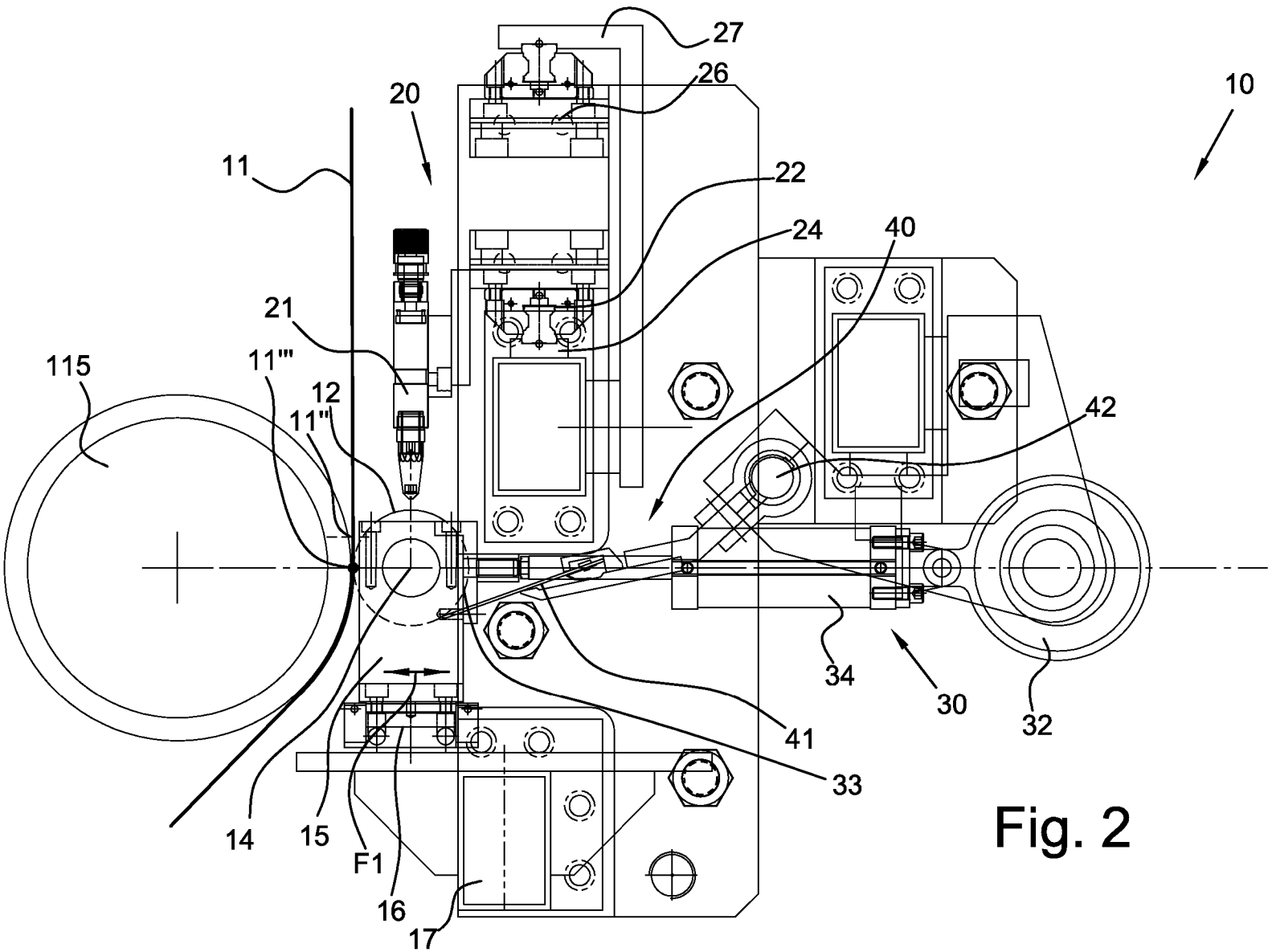
FIG. 2 is an enlarged lateral schematic view of the gluing group for applying glue to an end edge of a log according to the present invention.

After being provided with a glue line 11''', the delivery roller 12 then approaches the paper 11 very quickly by means of a linear actuator 30, according to a movement guided by the translation slides 16, thus performing an alternating forwards-backwards movement according to the arrow F1 of FIG. 2, preferably in the order of about 1 cm of excursion.

The linear actuator 30 according to a preferred embodiment comprises one mechanical cam mechanism provided with a servomotor, not shown, with an eccentric element 32 and with an approaching rod 33, integrally connected to the delivery roller 12, in the example through a bracket connected to the supporting elements 15 of the delivery roller 12.

The pressure between the delivery roller 12 and the paper 11 takes place using the return roller 115 that acts as a contrast roller during contact between the delivery roller 12 and the paper 11.

According to a further preferred embodiment, between the eccentric element 32 and the approaching rod 33 there is a damping device 34, which in the example shown comprises a pneumatic piston with the front chamber at a preset pressure, which ensures a soft approach between the delivery roller 12 and the contrast roller 115. According to what is known, the determination of the pressure of the damper piston chamber determines the rigidity of the damping device 34.

According to a preferred embodiment, the mechanical cam mechanism and the damping device 34 could be arranged on both flanks 101 of the machine, providing in each case a single motor with a torsion bar. According to the invention it could however be sufficient to have a single mechanical cam mechanism acting on the delivery roller 12.

The gluing group 10 for applying glue to an end edge of a log according to the present invention preferably also comprises a cleaning scraper 40, in contact with the delivery roller 12 in the lower part thereof, in order to remove the deposits of glue which has not been transferred to the paper which inevitably remains present on the delivery roller 12 itself.

The cleaning scraper 40 comprises a spatula 41, or a plurality of spatulas 41 in the same number as the number of chunks 12' of the delivery roller 12, that is mounted hinged on a motorized axis 42 so as to tilt in rotation in order to be put in contact with the delivery roller 12 or away therefrom.

The cleaning scraper 40 also has a braking action on the delivery roller 12 which, being idle, is dragged in rotation due to the effect of the contact with the paper 11 advancing at the winding speed of the rewinding machine 100, for example about 600-700 m/min, and which must subsequently be stopped in order to receive a new glue line.

The method for gluing an end edge of a log, according to the present invention, envisages the following steps:

delivering a glue line 11''' on a delivery roller 12 in an idle way by means of delivery means of a glue line 20 during the winding step of a log 11' which is being formed in a rewinding machine 100;

putting the delivery roller 12 into contact with the paper 11 against a return roller 115 by means of a linear actuator 30 in a manner phased with respect to the piercing 11" intended for breaking so as to rotatably drag the delivery roller 12 and;

delivering a glue line 11''' on the paper 11 being wound in a predetermined position upstream of the piercing line 11" intended for breaking, for example about 1-3 cm away from the piercing line, intended for breaking 11", which will determine the formation of the end edge;

distancing the delivery roller 12 from the paper 11, cleaning any residual glue from the same and stopping its rotation for arranging it to receive a new glue line 11'''.

The duration of the approaching and distancing movement of the delivery roller 12 has a direct effect on the number of revolutions that the delivery roller 12 performs in contact with the paper 11 being wound. Determining parameters are, in addition to the diameter of the delivery roller 12 itself, also the feed speed of the paper 11 and the stroke of the linear actuator 30. Based on the desired time for the approaching and distancing movement of the delivery roller 12, a relative eccentric element will be designed able to guarantee the necessary times.

In any case, it could be acceptable according to the invention to have a circumstance in which the delivery roller 12 performs more than one revolution in contact with the paper 11, since the further revolution, or revolutions, that the delivery roller 12 performs in contact with the paper 11, i.e. subsequent to the first glue delivery revolution, deposit at most the lightest strips of glue, not very visible, on the part of paper 11 intended to perform the first windings on the subsequent core.

The gluing group for applying glue on an end edge of a log, the rewinding machine bearing such group and the related gluing method according to the present invention have the advantage of not requiring the presence of a device dedicated to closing the log with glue downstream of the rewinding machine.

The gluing group for applying glue to an end edge of a log, the rewinding machine bearing such group and the related gluing method thus conceived are susceptible to numerous modifications and variants, all falling within the scope of the invention; furthermore, all the details can be replaced by technically equivalent elements. In practice, the materials used, as well as the dimensions, can be of any type according to the technical requirements.

The invention claimed is:

1. A gluing group for a rewinding machine for applying glue to an end edge of a log, comprising: a delivery roller (12) supported in an idle manner by supporting and translation guiding elements (15, 16), delivery means (20) for delivering a glue line (11') on one of the generatrices of the delivery roller (12), a linear actuator (30) connected to said delivery roller (12) to transmit the approaching and distancing movement of the delivery roller (12) against a paper (11) being wound onto a contrast roller (115), wherein said delivery means (20) for delivering said glue line (11''') comprise a series of guns (21), glue-fed under pressure and movable transversely along the delivery roller (12), in order to make glue segments on one of the generatrices of the delivery roller (12).

2. The gluing group according to claim 1, wherein said delivery roller (12) is made as a plurality of roller chunks (12'), which are aligned on a single axis (14) and supported by the supporting elements (15), coupled to translation slides (16).

3. The gluing group according to claim 1, wherein said delivery roller (12) is made of a low-inertial and non-stick material, as plastic material or carbon fiber.

4. The gluing group according to claim 1, wherein said guns (21) are each supported by an own supporting and translation guiding element (22, 24), movable by means of a belt drive (23) that is motorised with an alternative linear movement.

5. The gluing group according to claim 4, wherein said supporting and translation guiding element comprises a runner (22) movable along a lower guide (24).

6. The gluing group according to claim 1, wherein said linear actuator (30) comprises at least one mechanical cam mechanism provided with a servomotor, with an eccentric element (32) and with an approaching rod (33), integrally connected to the delivery roller (12).

7. The gluing group according to claim 6, wherein between the eccentric element (32) and the approaching rod (33) a damping device (34) is arranged.

8. The gluing group according to claim 7, wherein said damping device (34) is made of a pneumatic piston with the front chamber at a preset pressure, which ensures a soft approaching between the delivery roller (12) and the contrast roller (115).

9. The gluing group according to claim 1, further comprising a cleaning scraper (40), in contact with the delivery roller (12) in the lower part thereof, in order to remove the deposits of glue which has not been transferred to the paper.

10. The gluing group according to claim 9, wherein said cleaning scraper (40) comprises at least one spatula (41) that is mounted hinged on a motorised axis (42) so as to tilt in rotation in order to be put in contact with the delivery roller (12) or away therefrom.

11. A rewinding machine, comprising: a piercing group (120) of paper (11), at least one return roller (115) for diverting the paper (11), three winding rollers (112, 113, 114) for winding a roll or log (11'), said rollers having axes parallel to each other and perpendicular to the feed direction of the paper (11), a feeding group for feeding cores (130) towards the winding area of the log (11'), wherein the rewinding machine (100) is provided with a gluing group (10) for gluing an end edge of a log according to claim 1, wherein said glue delivery roller (12) is movable forward and away against the return roller (115) of the paper (11) of the rewinding machine (100).

12. A method for gluing an end edge of a log in a rewinding machine, comprising: delivering a glue line (11') on a delivery roller (12) in an idle manner through a series of guns (21), glue-fed under pressure and movable transversely along the delivery roller (12) in order to make glue segments on one of the generatrices of the delivery roller (12) during the winding step of a log (11') being formed in a rewinding machine (100); putting the delivery roller (12) in contact with the paper (11) against the return roller (115) by means of a linear actuator (30) in a manner phased with the piercing (11") that is intended for breaking so as to drag the delivery roller (12) in rotation and; delivering said glue line (11'") on the paper (11) being wound in a predetermined position upstream of the piercing line (11") intended for breaking, which will determine the formation of the end edge; moving the delivery roller (12) away from the paper (11), cleaning the same from residual glue and stopping the rotation thereof in order to arrange it to receive a new glue line (11'").

* * * * *